United States Patent [19]

Grooms et al.

[11] Patent Number: 5,064,314

[45] Date of Patent: Nov. 12, 1991

[54] VACUUM SEWERAGE SYSTEM WITH INCREASED LIFT CAPABILITIES HAVING ELECTRIC AIR ADMISSION CONTROLLERS

[75] Inventors: John M. Grooms; Mark A. Jones, both of Rochester, Ind.

[73] Assignee: Burton Mechanical Contractors, Inc., Rochester, Ind.

[21] Appl. No.: 615,088

[22] Filed: Nov. 19, 1990

Related U.S. Application Data

[63] Continuation-in-part of Ser. No. 491,255, Mar. 9, 1990.

[51] Int. Cl.[5] ..... B01D 1/00

[52] U.S. Cl. ..... 406/22; 406/48; 406/93

[58] Field of Search ..... 406/14, 15, 18, 19, 406/22, 48, 50, 93; 137/236.1, 209

[56] References Cited

U.S. PATENT DOCUMENTS

| | | | |
|---|---|---|---|
| 1,964,167 | 6/1934 | Needham | 406/22 |
| 3,814,542 | 6/1974 | Inglesias et al. | 406/15 |
| 4,171,853 | 10/1979 | Cleaver et al. | 406/48 |
| 4,179,371 | 12/1979 | Foreman et al. | 406/50 |
| 4,261,672 | 4/1981 | Marbach | 406/50 |
| 4,775,267 | 10/1988 | Yamamoto | 406/50 |

*Primary Examiner*—Sherman Basinger
*Assistant Examiner*—Stephen P. Avila
*Attorney, Agent, or Firm*—Jones, Day, Reavis & Pogue

[57] ABSTRACT

An improved vacuum sewerage system for transmitting sewage through an intermittently opened sewage control valve of a transport conduit by means of differential pressure. The vacuum conduit is laid out in a saw-toothed fashion, having a riser, a low point, and a downslope. When no sewage is being transported through the conduit, any residual sewage in the conduit collects in the low point, with minimal intermittent closure of the conduit over time to permit minimal drop in vacuum or subatmospheric pressure throughout the conduit such that there is more than adequate vacuum or subatmospheric pressure available to operate the control valve. When the control valve is opened, the sewage transported through the vacuum conduit forms a generally hollow cylindrical mass, which is propelled toward a vacuum collection tank. The system includes an electric air admission controller ("EAAC"), which automatically opens and closes an air control valve independently of the level of accumulated sewage upstream of the sewage control valve, in order to inject additional air at atmospheric pressure into the vacuum transport lines to apply additional fluid pressure to a mass of sewage therein, and to avoid a waterlogged condition by supplementary transport. A conduit line having more than 13 feet of total lift is thereby possible, provided that the sum of the pressure losses across all the risers equals or exceeds the sum of the minimum subatmospheric pressure condition available at the vacuum collection station minus the pressure head required to operate the control valve.

30 Claims, 8 Drawing Sheets

10
12
15
18
20
22
24
26
28
30
32
40

DELAY-TIMER
ON-TIMER
125
120
17
100
SOURCE OF ATMOSPHERIC PRESSURE
104
OUT IF ABOVE 12" Hg
130
PRESSURE SWITCH
IN
-110 V
+110 V
112
132
VACUUM FROM POINT IN CONDUIT LINE IMMEDIATELY DOWNSTREAM OF CONTROL VALVE
106
SOURCE OF VACUUM OR SUBATMOSPHERIC PRESSURE
107
102
TO CONTROL VALVE
41
80
67
70
42
77
75
15
134
71
47
73
85
82
46

VACUUM SEWERAGE SYSTEM WITH INCREASED LIFT CAPABILITIES HAVING ELECTRIC AIR ADMISSION CONTROLLERS

CROSS-REFERENCE TO RELATED APPLICATION

This is a continuation-in-part of U.S. patent application Ser. No. 491,255, filed on Mar. 9, 1990, in the name of John Grooms.

BACKGROUND OF THE INVENTION

The present invention relates generally to vacuum-operated sewerage control systems utilizing inlet vacuum valves, and more specifically to such a system employing an electric air admission controller ("EAAC") for opening the vacuum valve independently of the level of sewage accumulated in a holding tank at the inlet of the valve, in order to introduce additional air at atmospheric pressure into the sewerage transport conduit to avoid a waterlogged state.

Sewerage systems initially were gravity operated, including a network of underground pipes leading from various sources of waste (e.g., homes, businesses, etc.) to a sewage treatment plant. However, irregular terrains and distances posed between the entry and collection points of the waste significantly limited the ability to dig deep trenches to provide a continuous, downhill flow of sewage. Thus, mechanical pumps were placed at strategic points along the pipe network to provide a positive force behind waste flowing in a more-shallowly laid piping network. In actuality, though, pressure pumps were needed at every sewage input point for such a system.

Vacuum-operated systems were proposed as an alternative, as exemplified by U.S. Pat. No. 3,115,118, issued to S. A. J. Liljendahl. The Liljendahl patent describes a vacuum system which uses two separate piping networks to carry different effluent streams. While the waste products from bathtubs, wash basins, sinks, etc. (gray water), are conveyed by a conventional gravity system, waste products discharged from water closet bowls, urinals, and similar sanitary apparati (black water) are transported by a separate, vacuum system. The conduits in the latter system are provided with "pockets" in which sewage is collected so as to form a plug which entirely fills the cross-sectional area of the pipe and effects conduit closure. A plug of sewage is moved by a pressure differential force along a conduit in an integral condition. The kind of vacuum-operated system taught by the Liljendahl patent is called "plug flow."

U.S. Pat. No. 3,730,884, issued to B. C. Burns et al., describes a sewerage system using "vacuum-induced plug flow" in which both black water and gray water are handled by a single piping system. A "coherent plug" of sewage is transported by a vacuum pressure differential through a pipe for a short distance. The plug will disintegrate, however, as it moves through the pipe due to friction and other forces, resulting in a diminishment of the pressure differential moving the plug. Therefore, a series of plug reformers, which in their simplest form may be a dip or pocket in the pipe, serve as a trap for sewage and aid in the reformation of a coherent plug. The pockets are designed so that sewage entirely fills the pipe bore. Operation of the system requires that the plug of sewage seal the pipe bore. This process of alternate plug disintegration and reformation continues until the sewage eventually passes completely through the pipe. The pressure differential for each of these plugs is less than the total available system pressure differential because of the serial arrangement of the plug pockets in a pipe.

U.S. Pat. No. 4,179,371, issued to B. E. Foreman et al., describes an apparatus and method for transporting sewage from a source of sewage to a collection means. A pressure differential is maintained in the piping between the source and the collection means. Sewage is transported through the conduit in the form of a generally hollow cylinder. When no sewage is being transported, the residual sewage retained in the conduit generally does not close the conduit, and permits the same pressure to be maintained throughout the conduit. Injection means are provided, which may be a valve intermittently opened in response to a predetermined condition. The conduit is laid out in a saw-toothed configuration with a combination of a riser portion, a downslope portion, and a low point portion (collectively called a "lift") in which residual sewage not discharged from the system may collect. The residual sewage is generally insufficient to close the conduit, thereby permitting communication of the same pressure throughout the conduit. Thus, the apparatus, as disclosed by Foreman, may include a gravity-fed sewage collection tank at atmospheric pressure having its contents intermittently injected into a vacuum-pressurized conduit laid out in saw-toothed fashion, which permits full vacuum to be communicated throughout the conduit under typical operating conditions.

A problem encountered by vacuum transport sewerage systems is "waterlogging." As already discussed, the collection of residual waste material in the low point portions of the conduit, under normal operating conditions, is insufficient to seal the conduit at low points, and is designed to maintain throughout the conduit an air space in the conduit to permit pressure communication. During a sewage transport cycle, the total conduit volume will typically be less than one-third liquid. However, if an insufficient amount of atmospheric air is introduced into the conduit, there will be insufficient energy applied to move effectively the entire waste mass during the sewage transport cycle. This leads to an increased accumulation of residual waste material, thereby creating the waterlogged condition which might fill two-thirds of the conduit and lift volumes.

There are a number of potential causes of waterlogging. For example, the valve assembly may be misadjusted so that the valve closes too quickly after the waste material has entered the conduit, thereby undesirably reducing the amount of atmospheric air entering the conduit and pulling the waste material along. Likewise, leakage somewhere in the system will impair the maintenance of vacuum or subatmospheric pressure in the conduit so that over time, this vacuum or subatmospheric pressure condition will decrease to the point that the differential pressure during transport cycles will be insufficient to move waste product, resulting in waterlogging. Also, while the conduit network will equalize to a vacuum or subatmospheric pressure after the valve closes, terminating the sewage transport cycle, it will do so at a slightly lower vacuum pressure due to inefficiency in the system or improper operation of the source of vacuum or subatmospheric pressure. This, in turn, contributes to a deficient level of vacuum or subatmospheric pressure and, therefore, pressure differential.

While waterlogging theoretically may occur no matter how many feet of lift are in the conduit line, the probability will increase, as the "total lift" is increased, because it will be more difficult for gravity fall and the vacuum to lift sewage within the conduit lines at each succeeding profile change. Assuming that each saw-toothed lift consists of a lower downslope portion, a riser, and an upper downslope portion, the pertinent distance is measured vertically between the point on the bottom exterior surface of the upper downslope portion where it joins the riser, and the point on the top exterior surface of the lower downslope portion where it joins the same riser. Aggregating these distances across the lifts of the flow path produces a measurement for the "total lift."

Typically, a vacuum system operates within a range of 16" Hg to 20" Hg vacuum. Because atmospheric pressure, on the other hand, is defined as 0" Hg in this vacuum pressure scale, this represents "a pressure differential" of 16" Hg to 20" Hg also. Taking the minimum available vacuum level of 16" Hg, and subtracting 5" Hg which must be present at all times to operate the vacuum valves and their controls, leaves 11" Hg vacuum available for vacuum lift in the mains. Eleven inches of mercury is equivalent to 12.5 feet of water, which is typically rounded up to 13 feet. Thus, 13 feet of lift is typically the maximum figure used in the design of the vacuum mains for any sewer project.

Total lift of approximately 13 feet is important for two reasons. First, any system with less than 13 feet of lift which waterlogs can theoretically correct itself over time through normal valve cycling to purge the accumulated residual sewage from the conduit line. By contrast, a waterlogged vacuum transport system designed with 13 feet or more of total lift traditionally has needed operator assistance to purge the residual sewage. Because the valve opens in response to differential pressure based upon the vacuum pressure condition in the conduit immediately downstream of the valve, if that vacuum pressure is too low due to waterlogging blockage of the conduit, the valve will not cycle to introduce atmospheric pressure into the conduit, thereby preventing the conduit from automatically unwaterlogging itself over time. Instead, the repairman will have to restore the source of vacuum pressure in the system, move upstream to a valve having adequate vacuum pressure able to be activated and activate that valve, and then progressively activate each valve further upstream until the vacuum mains are cleared of the waterlogged sewage.

The second important aspect of the 13-foot measurement is that it presents a limitation on the overall length of the sewerage transport lines. Combination of the predetermined slope of the lines with a maximum total lift of 13 feet determines the maximum distance the vacuum lines may travel to ensure proper sewage flow without the aid of mechanical pumps. Actually, the total permitted lift across the flow path is limited additionally by a frictional loss factor calculated according to various formulae known in the art of fluid dynamics.

In order to operate effectively a vacuum sewage system at loss levels exceeding about 13 feet, a higher air-to-liquid ratio is used. This may be simply accomplished by admitting more air into the conduit. Typical systems operating at or below the 13-foot level may be designed at a 3-to-1 air-to-liquid ratio. This number can be proportionately increased to increase lift within the system.

OBJECT OF THE PRESENT INVENTION

Accordingly, a primary objective of the present invention is to provide an apparatus and method for a plugless vacuum sewerage transportation system.

Another object of the invention is to provide a sewerage transport system which does not require extensive use of pumping stations to facilitate gravity flow of sewage.

Another object of the invention is to provide a sewerage transport system in which pumps are not required at each source of sewage for injecting the sewage into a collection conduit.

Another object of the invention is to provide a system and method for transporting sewage in which a single, relatively small-diameter pipe is used for plugless transportation of sewage without the need for plug reformers, and in which sewage is injected into the system by a pressure differential.

Another object of the invention is to provide a system and apparatus for transporting sewage which is injected into the system by a pressure differential, which system does not require the use of sewage plugs and plug reformers.

Yet another object of the invention is to provide a system and apparatus for transporting sewage by a vacuum pressure differential providing full pressure differential to the sewage injected into such a system.

Still another object of the present invention is to provide a vacuum sewerage transport system which can automatically avoid waterlogging through a system component malfunction or misadjustment.

Another object of the present invention is to provide an apparatus which will act to open and close a vacuum valve to admit additional air to a vacuum main to avoid the vacuum main becoming waterlogged, independent of the normal activation of the vacuum valve to admit accumulated waste matter from a holding tank into the vacuum main.

Yet another object of the present invention is to allow the construction of vacuum sewerage pipe networks with total lift exceeding 13 feet.

SUMMARY OF THE INVENTION

Briefly, the invention is directed to providing an improved apparatus and method for transporting a mass of sewage from a source of sewage to collection means. A pressure differential is maintained between the source and the collection means. Sewage is injected into a conduit through a sewage control valve opened in response to a predetermined condition, and forms a hollow cylinder. When no sewage is being transported, the conduit has substantially the same pressure throughout. The conduit is laid out in a saw-toothed configuration with a riser portion, a downslope portion, and a low-point portion in which residual sewage which was not swept through the conduit and discharged during the transport cycle collects at rest, with minimal intermittent closure of the conduit over time in order to permit minimal drop in vacuum or subatmospheric pressure throughout the conduit such that there is more than adequate vacuum or subatmospheric pressure available to operate the control valve. According to another aspect of the invention, the apparatus includes a gravity-fed sewage collection tank at atmospheric pressure, having its contents intermittently injected through the sewage control valve into a vacuum-pressurized conduit laid out in saw-toothed fashion, which permits full vacuum generally to be communicated throughout the conduit.

Coupled with the vacuum sewerage transport system described above is an EAAC apparatus for automatically opening and closing an air control valve connected to the vacuum sewerage transport conduit having a sewage control valve, independently of the level of accumulated sewage upstream of the sewage control valve, in order to inject additional air at atmospheric pressure into the vacuum transport lines to apply additional fluid pressure to a mass of sewage therein, and to avoid a waterlogged condition by supplementary transport. In its simplest form, the apparatus comprises a solenoid valve and a timer unit. When the timer unit is activated, it in turn activates the solenoid valve which responds by delivering vacuum or subatmospheric pressure from an external source to the air control valve to open it by application of differential pressure. When the on-timer cycle is completed, atmospheric pressure is once again delivered to the air control valve to close the valve. The predetermined frequency and duration of timer activation is calculated to permit sufficient atmospheric air to be introduced into the transport conduit to, on average, prevent waterlogging.

In a preferred embodiment, a pressure switch and timer-delay module are added to the EAAC system. The pressure switch monitors the level of vacuum pressure differential in the transport conduit downstream of the control valve. When the vacuum pressure falls to or below a pre-determined level, e.g., 12" Hg, the pressure switch activates the timer-delay component. When the timer-delay cycle is completed, if the level of vacuum pressure differential in the conduit line is still deficient, then the timer component is activated. This component in turn activates the solenoid valve.

Moreover, the timer-delay component is activated again, and the pressure switch remonitors the level of vacuum pressure in the transport conduit until the timer-delay cycle is completed. In another preferred embodiment, the timer and timer-delay components or modules have control knobs for adjusting the duration of their respective activation cycles.

In yet another preferred embodiment, the EAAC is combined in tandem with the sensor-controller module, which normally cycles the sewage vacuum control valve when a certain pre-determined level of sewage is accumulated in a holding tank upstream of the sewage control valve. In this particular embodiment, the solenoid valve, when activated, responds by delivering atmospheric pressure from an external source to the sensor-controller module. This, in turn, acts to open the sewage control valve by application of differential pressure. When the timer cycle is completed, vacuum pressure is once again delivered to the sensor-controller module, which reverses the differential pressure process and, in turn, responds by closing the sewage control valve. In this particular embodiment, the special air control valves are unnecessary.

When the EAAC apparatus is combined with the vacuum sewerage transport system, multiple saw-toothed profiles may be employed in the vacuum conduit such that the sum of the pressure losses across all the risers equals or exceeds the sum of the minimum vacuum or subatmospheric pressure condition available at the vacuum collection station minus the pressure head required to operate the control valve. In so doing, more than 13 feet of total lift may be designed into the conduit line.

DETAILED DESCRIPTION OF THE PREFERRED EMBODIMENT

Figures 1A, 1B, 1C, 2:
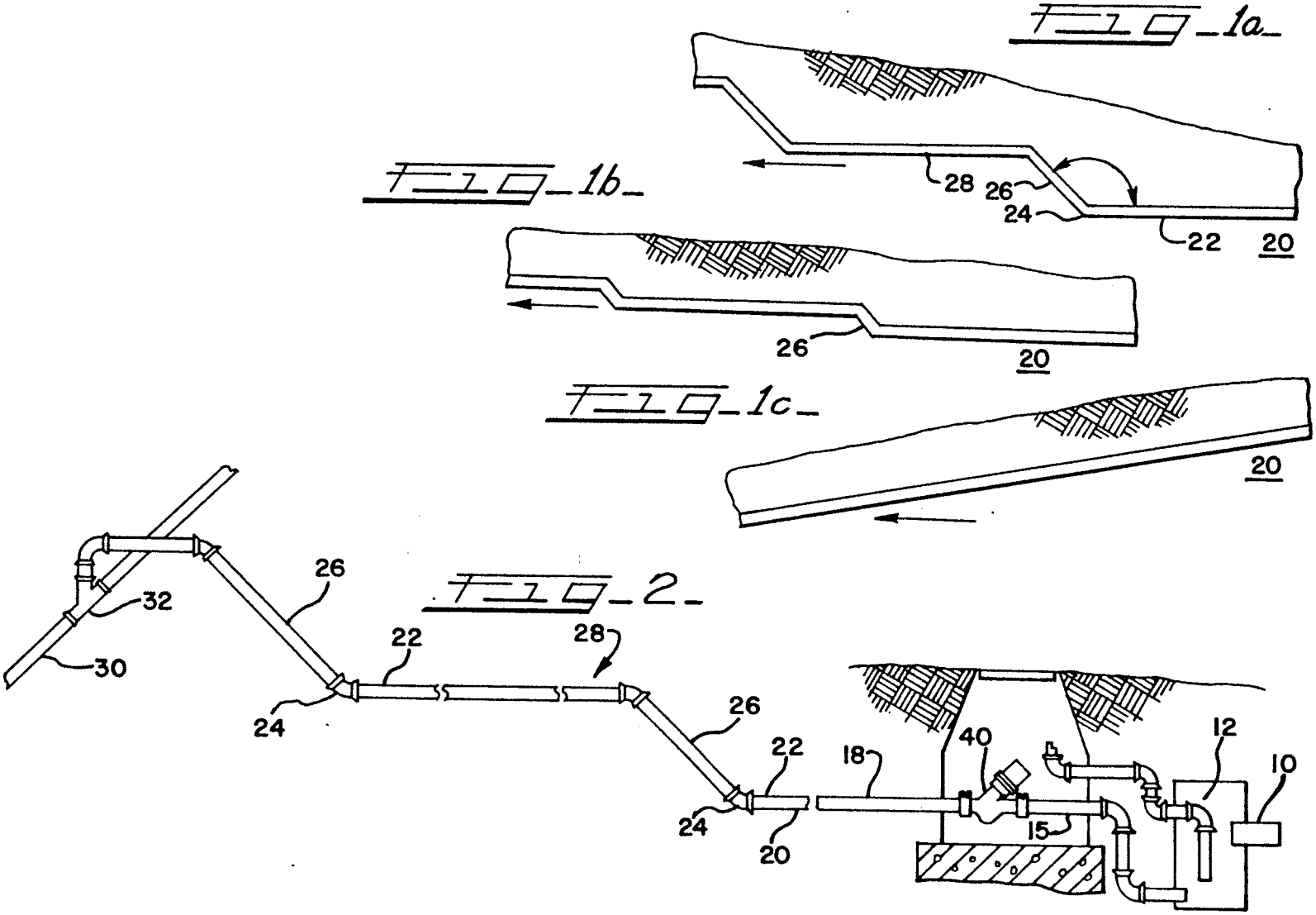
FIGS. 1*a*, 1*b*, and 1*c* are schematic representations of a conduit of the invention, respectively, showing conduits having sewage flow generally uphill, on the level, and downhill.
FIG. 2 is a side view of a portion of a vacuum sewerage transport system according to the invention in which a gravity-fed tank and an injection valve are located below a main vacuum conduit.

Referring now to FIGS. 1*a*, 1*b*, and 1*c* of the drawings, conduit sections for facilitating the flow of sewage in the directions of the arrows shown, (uphill, on the level, and downhill, respectively) are represented.

When the flow proceeds uphill as in FIG. 1*a*, the vacuum conduit 20 as shown has a very slight downward sloping portion 22, a low point portion 24, and a riser portion 26. Remnants of the sewage which are not swept through the conduit 20 and discharged in a sewage transport cycle flow to and accumulate in the low point portion 24. The conduits as shown in FIGS. 1*a* and 1*b* are laid out in generally saw-toothed configurations as shown. Such a saw-toothed profile accommodates the topography (e.g., other conduits and rock layers), as well as incoming flows (from an individual vacuum valve or a branch main). With the saw-toothed arrangement, the sewage residue will generally be insufficient to seal the conduit 20 bore when the sewage motion has ceased at the end of a transport cycle. This permits essentially the same vacuum pressure to be maintained throughout the whole conduit, including that portion of the conduit above the material in the low portion 24 of the conduit.

FIG. 1*b* shows a system configured for essentially level terrain, having a somewhat shorter riser portion 26. FIG. 1*c* shows a system conduit for descending terrain and has no lift or riser portions. Various combinations of sections as shown in the figures may be utilized as required to form a multi-section system laid beneath irregular terrain.

FIG. 2 shows a portion of the system 34 according to the invention, encompassing the uphill-flow riser sections of piping as depicted in FIG. 1*a*, wherein like numbers represent similar system elements. Sewage from sources (not shown) is fed by gravity through pipes 10 to a gravity collection tank 12 in which sewage is stored temporarily. An outlet pipe 14 from the gravity collection tank 12 is connected to the inlet side of a pressure differential control valve 40. The sewage in the gravity collection tank 12 is subjected to atmospheric pressure. In response to a pre-determined system parameter, for example, a rise of the tank 12 level above a certain point, the pressure differential control valve 40 permits a volume of sewage to flow into a pipe 18.

A feeder vacuum conduit 28 having low point portions 24, riser potions 26, and downslope portions 22 provides lift as sewage is injected from the gravity collection tank 12 towards a main vacuum conduit 30 which is elevated above the gravity collection tank 12 as shown. The main vacuum conduit 30 is provided with reduced pressure by an appropriate vacuum source (not shown). Vacuum sewer main conduit 30, branches, and feeder conduit 28 may be constructed of, for example, polyvinyl chloride (PVC) or acrylonitrile-butadiene-styrene (ABS) plastic pipe. Joints may be solvent welded or provided with fittings having suitable vacuum-tight compression rings, as known in the art. For an installation with high sewage temperature, fiberglass pipe is used. Pipe sizes generally range between three and six inches in diameter. When lifts are required, the pipe downslopes are installed with a drop between lifts generally equivalent to at least 40% of the conduit diameter (80% if the diameter is smaller than 6") or 0.2% of the distance between lifts, whichever is greater. Branch connections 32 to a main conduit 30 are made with vertical wye and ninety degree ell as shown. When sewage is injected into a conduit junction, some of the sewage initially moves in a reverse direction to the normal flow direction. The minimum slope of 0.2% in the downslope causes the backflow sewage to collect at a low point.

Generally, the transport conduit network is continuously maintained under vacuum or subatmospheric pressure, because the sewage does not form plugs which seal the bore of the conduit, thereby permitting full vacuum differential pressure to be applied to sewage entering the vacuum system 34 from holding tank 12 through the pressure differential control valve 40. Instead, sewage and air, usually at atmospheric pressure, are introduced for transport into the conduit through an open vacuum valve 40. The air moves down the length of the conduit to the area under vacuum or subatmospheric pressure where the air expands volumetrically. The energy created by the rapid movement of air in response to the differential pressure condition in the conduit, in turn, causes the sewage eventually to take the form of a hollow cylinder and produces rapid sewage transport throughout the conduit system. The force lifts all of the sewage trapped in the low point portions 24 up through the riser. This results in sewage velocities of from fifteen to eighteen feet per second, for example, when a ten to fifteen gallon volume of sewage enters such a system.

At a predetermined point in time, however, the vacuum valve will close, thereby ending the sewage transport cycle. The expansion of air causes a reduction in its pressure and velocity, and any residual waste not transported through the conduit network during the sewage transport cycle comes to rest. The conduit downstream of the vacuum valve is equalized by the source of vacuum pressure to a substantially constant subatmospheric or vacuum pressure condition throughout. Any residual waste not transported through the conduit during the sewage transport cycle will generally come to rest in the low point portion, with minimal intermittent closure of the conduit over time in order to permit minimal drop in pressure differential across each saw-toothed profile throughout the conduit such that there is more than adequate vacuum or subatmospheric pressure available to operate the control valve.

Vacuum valves function within this system by sealing and unsealing the passage between two parts of an evacuated system to define a transport cycle. The general structure and method of operation of this type of vacuum valve is described in U.S. Pat. No. 4,171,853, issued to D. D. Cleaver et al., as well as in applicants' co-pending application U.S. Ser. No. 366,585.

The conduit portion 30 downstream from the junction point 32 is straight and has no pocket formed therein. Thus, no obstacle is placed in the path of sewage swiftly passing through the pipe. The pressure differential control valve 40 is provided with timing means to maintain the valve in an open position for a period longer than that required to empty the contents of the gravity collection tank 12. This permits a quantity of atmospheric air, for example, twice the volume of sewage, to be injected into the main vacuum conduit 20 following the sewage mass. Were the bore of the conduit 20 to be closed by a plug of sewage, as taught by the prior art, pressure differentials would be created along the conduit, and there would be greater resistance to sewage flow which would limit operations to shorter lengths.

Figure 3:
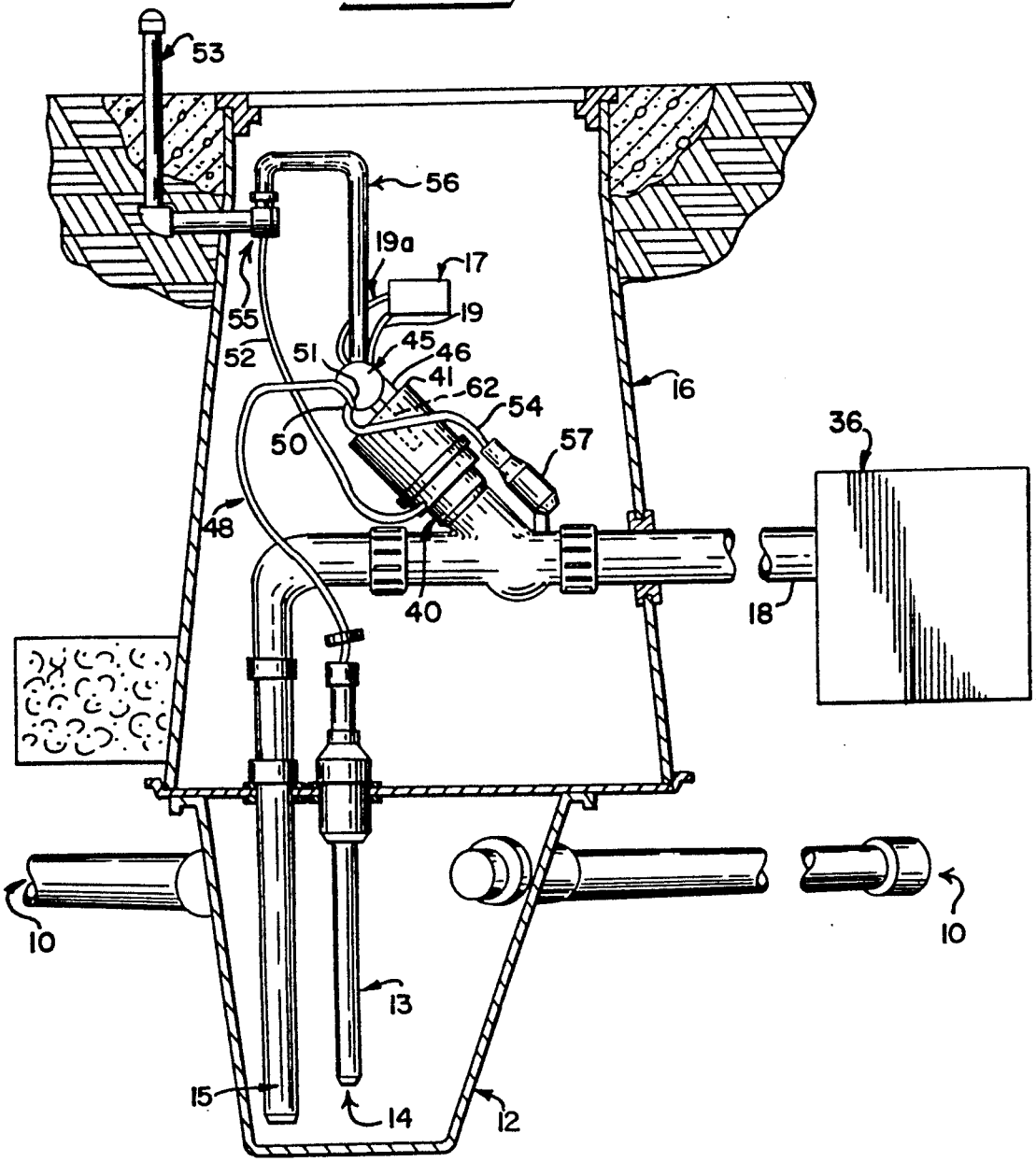
FIG. 3 is a diagramatic representation of a portion of the vacuum sewerage transport system of the invention, showing a control valve and the electric air admission controller ("EAAC")

FIG. 3 provides a close-up illustration of the upstream portion of the vacuum sewerage transport system 34 depicted in FIG. 2, where like elements have been assigned like numbers. A sensor pipe 13 is supported at the top of holding tank 12 and extends downwardly to a point inside the tank. The sensor pipe 13 extends from its top support upwards into a valve pit 16 into which the sensor pipe 13 opens.

Holding tank discharge conduit 15, having an inlet opening 14, also is suspended down into holding tank 12. It extends upwards through valve pit 16 and eventually into a sewage collection station 36, remote from the valve pit 16. Interposed in the discharge conduit 15 within the valve pit 16 is sewage control valve, generally designated 40. In the operation of the vacuum sewerage system, valve 40 is normally closed. Downstream from the control valve 40 in the discharge conduit 15, the line is maintained at subatmospheric or vacuum pressure, as is sewage collection station 36.

During operation of the system, sewage is discharged from a residential source into the gravity sewer conduit 10, which in turn discharges the sewage into holding tank 12. When the sewage content of the holding tank is such that a discharge cycle is needed (triggered by preselected pressure conditions in the holding tank), the control valve 40 is opened by the sensor control apparatus 45, which will be described more fully below, and triggers a normal sewage transport cycle. Opening the control valve 40 creates a differential pressure between the relatively low pressure or vacuum portion of the discharge conduit 15 downstream from the valve, and the higher or atmospheric pressure portion of conduit 15 upstream of valve 40. This pressure differential results in the very rapid discharge of the sewage content of holding tank 12 through the inlet opening 14 of discharge conduit 15 past control valve 40, and into and through the vacuum portion of discharge conduit 15, and ultimately to collection station 36 for subsequent processing or disposal. Upon completion of the sewage transport cycle by discharge of sewage from holding tank 12 through the discharge conduit 15, the control valve 40 is automatically closed, and the vacuum system 34 is restored to its normal stand-by condition.

Upon the upper end 41 of control valve 40 is mounted an integrated sensor-controller module 45. The control module is attached by means of bracket 46 and screws 47 (best seen in FIG. 7). One of the ends of a pressure sensor conduit 48 is disposed in pressure communication with the sensor pipe 13, and its other end is coupled to pressure sensor port 51, positioned at the lowest point of the sensor-controller module 45. Vacuum is supplied to the sensor-controller through a vacuum line 54 connected through a surge tank 57, which is more fully described in applicants' U.S. Pat. No. 4,171,853. The surge tank communicates with the vacuum portion of discharge conduit 15, thereby supplying a constant subatmospheric or vacuum pressure source to the sensor-controller through vacuum line 54 and vacuum port 50.

Figure 7:
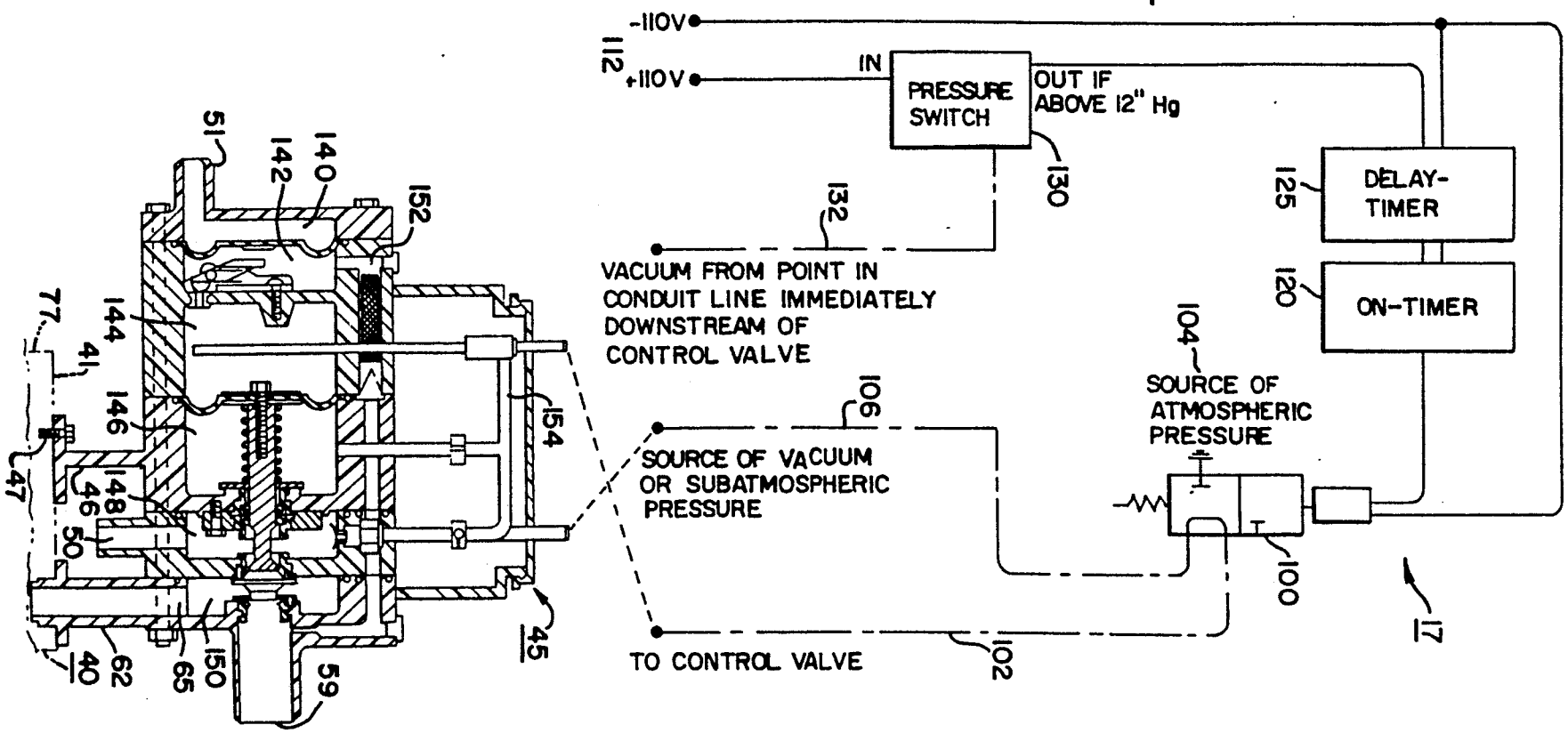
FIG. 7 shows the EAAC embodiment of FIG. 5 connected to a sensor-control module and the upper housing of a waste vacuum control valve.

Atmospheric pressure, on the other hand, is directed to the sensor-controller 45 from above the ground surface of the installation through an air breather 53, which communicates with an atmospheric pressure conduit 56, thereby supplying atmospheric pressure to the sensor-controller through atmospheric port 59 (as seen in FIG. 7). At the same time, atmospheric pressure is delivered to the lower housing chamber of the pressure differentially operated valve 40 from atmospheric pressure conduit 56 via atmospheric pressure conduit 52, which joins the former at junction point 55.

The sensor-controller 45 communicates with the pressure differentially operated valve 40 via a valve connector 62 disposed in pressure communication with the upper end 41 of valve 40 and valve connector port 65 of module 45 (see FIG. 7).

Figure 4:
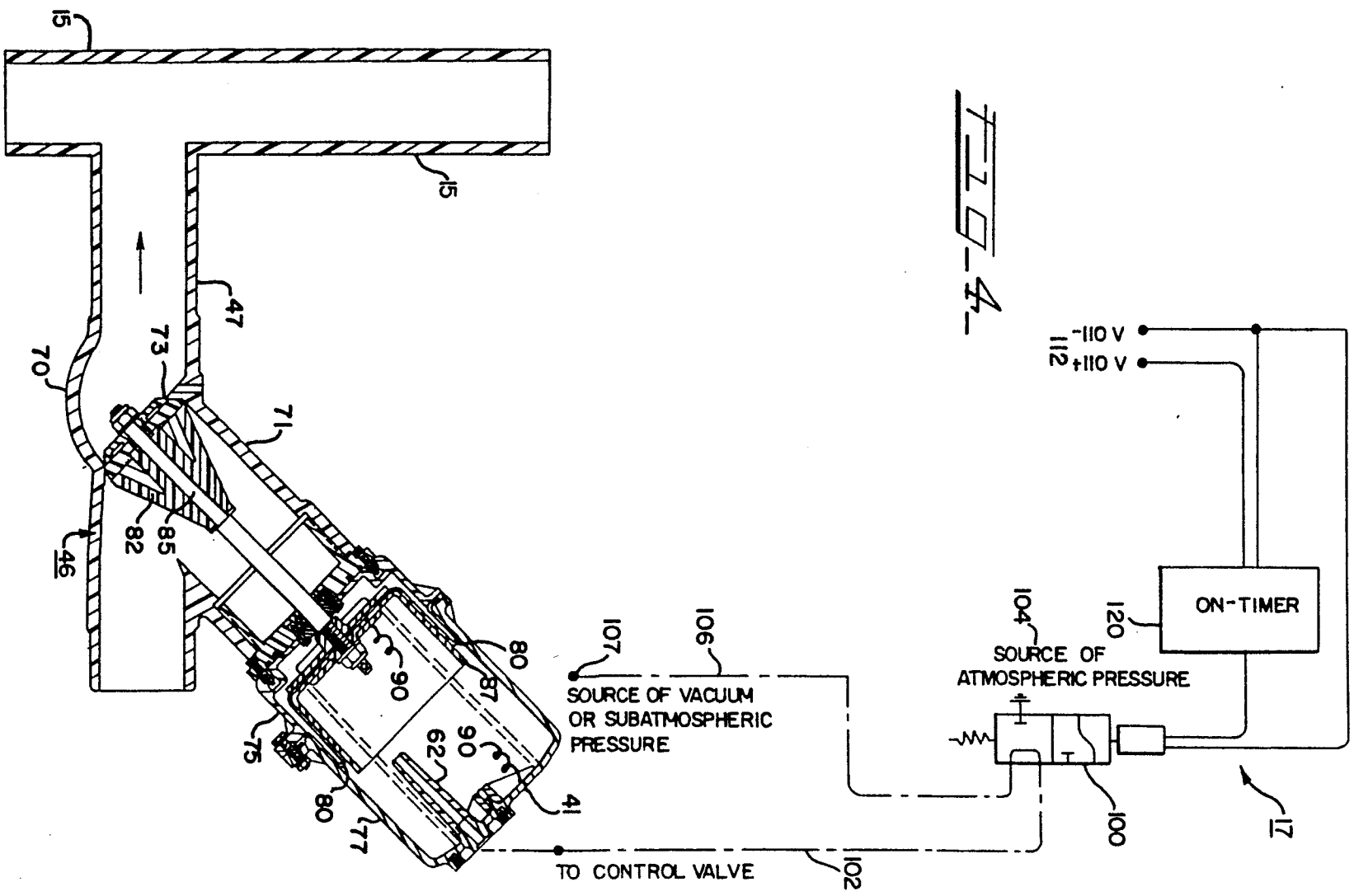
FIG. 4 is a schematic view of the EAAC unit of the invention connected to an air control valve in cross-section.

The EAAC module 17 is designed to open the control valve 40 to admit atmospheric air during an air transport cycle of pre-determined length in order to prevent the onslaught of, or correct the existence of, a waterlogged condition in the sewage transport conduit 15. The simplest manner to achieve this objective is to join one or more air valves 46 coupled to an EAAC module 17 at strategic locations in the conduit line 15 by means of a connecting conduit 47, as shown in FIG. 4. These air valves 46 are independent of the sewage control valves 40 positioned immediately downstream of each sewage holding tank 12 (as shown in FIG. 3) but have the same mechanical structure, and operate in the same manner.

The details of the structural and functional interaction of the pressure differentially operated air valve 46 and sewage control valve 40 and the valve connector 62 are discussed in great detail in applicants' U.S. Pat. No. 4,171,853 and U.S. Ser. No. 366,585. Basically, air valve 46 has a wye-body conduit 70 with a valve housing 71 and an internal valve seat 73. Mounted to valve housing 71 are a lower housing chamber 75 and an upper housing chamber 77, divided by diaphragm 80. One end of plunger assembly 82 mates with internal valve seat 73 in order to provide an air and water-tight seal. Plunger assembly 82 is attached to piston rod 85 and can move longitudinally within valve housing 71. The other end of piston rod 85 is attached to piston-cup 87. Spring 90 is positioned between piston-cup 8 and the top side 41 of upper housing chamber 77 in order to bias plunger assembly 82 tightly in contact with internal valve seat 73.

In the standby position with plunger assembly 82 sealed against internal valve seat 73 (i.e., "closed" position), the upper housing chamber 77 is at atmospheric pressure. Meanwhile, air at atmospheric pressure enters wye-body conduit 70 to fill valve housing 71 and lower housing chamber 75 at all times. However, when vacuum or subatmospheric pressure enters the upper housing chamber 77 through valve connector 62, the atmospheric pressure in lower housing chamber 75 deflects diaphragm 80 upwards toward the top side 41 of upper housing chamber 77. This action, in turn, moves piston cup 87 against spring 90 and with it piston rod 85 so that plunger assembly 82 moves away from internal valve seat 73. In this way the valve "opens." Once atmospheric pressure is returned to upper housing chamber 77, the process reverses and the valve closes. Thus, the key to opening air control valve 46 is to introduce vacuum or subatmospheric pressure into upper housing chamber 77.

FIG. 4 also shows a schematic diagram of EAAC module 17 in its simplest form. A 3-way, 2-position, spring-return electric actuated valve ("solenoid valve") 100 is used to deliver air at a selected pressure condition to valve connector 62 and upper housing chamber 77 of air valve 46 by means of pressure delivery line 102. At the same time, solenoid valve 100 receives air at atmospheric pressure by means of atmospheric pressure source 104, and vacuum or subatmospheric pressure by means of vacuum line 106. The source 107 of the vacuum or subatmospheric pressure could be either a vacuum pump or else the vacuum or subatmospheric pressure within conduit line 15, itself.

While many different models and brands of solenoid valves may be used in the present invention, applicants employ a particular solenoid valve Model No. B15DK1040 made by the Skinner Valve Division of Honeywell. In response to electrical current provided by power source 112, a magnetic coil in the solenoid valve 100 will cause, by means of interaction of the mechanical parts, vacuum or subatmospheric pressure to be passed to upper housing chamber 77, and the air valve 46 opens. Termination of flow of electrical current to solenoid valve 100, by contrast, will cause atmospheric pressure to be delivered to the upper housing chamber 77, thereby closing the air valve 46.

If means is not provided to interrupt flow of electrical current to solenoid valve 100, however, then air valve 46 will perpetually be in the "open" position, forever flooding conduit line 15 with atmospheric pressurized air. This will thwart formation of a pressure differential in the conduit line 15, preventing swift transport of sewage when passed from holding tank 12 through control valve 40 during a sewage transport cycle (see FIG. 3). Therefore, a timer module 120 is interposed within the electrical circuit between power source 112 and solenoid valve 100. Typical timers used include those sold by National Controls Corporation of West Chicago, Ill. Such a timer provides an electrical flow path which is interrupted for a pre-determined period of time. The timer may have means for adjusting this period of deactivation. Hence, solenoid valve 100 will receive electrical current only when the timer module 120 is activated to complete the electrical circuit. In this way, air valve 46 will cycle to provide intermittent introduction of air at atmospheric pressure in conduit line 15 to prevent waterlogging.

Figure 5:
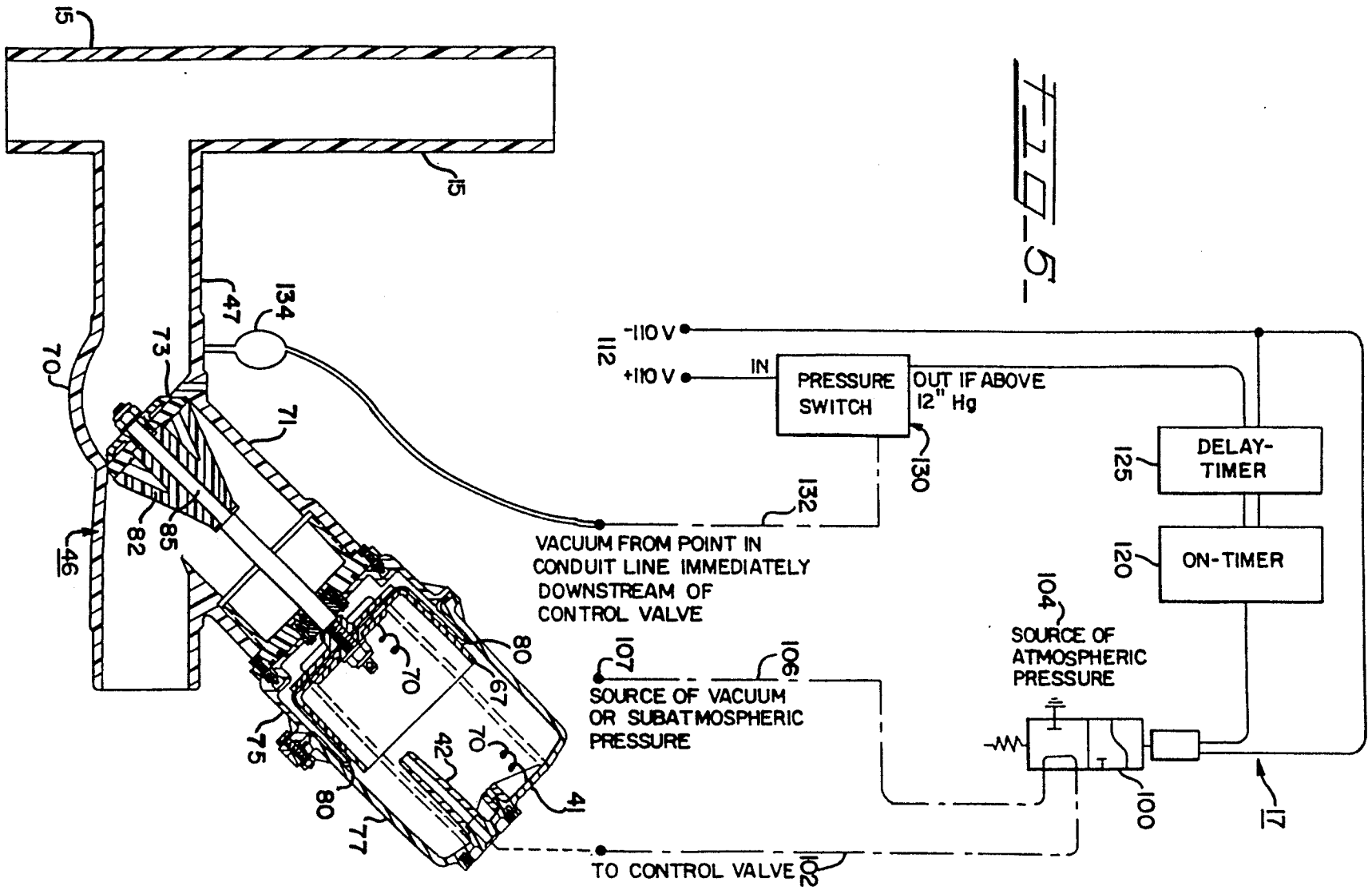
FIG. 5 is the same as FIG. 4 except that a pressure switch and delay-timer module have been added to the schematic diagram of the EAAC.

A preferred embodiment of the present invention is shown in FIG. 5. Rather than adjust the timer module's activation period to produce an air transport cycle for the air valve 46 sufficiently long, on average, to prevent the differential pressure in the conduit line from falling to or below a pre-determined level, such as 12" Hg, a pressure-activated, double-pull, single-throw electric switch ("pressure switch") 130 is placed in the electrical circuit of EAAC module 17 between power source 112 and on-timer module 120. A typical pressure switch used is the combination of Switch Unit No. PB30A and Transducer Unit No. RV34A32, both sold by Automatic Switch Co. of Florham Park, N.J. Vacuum line 132 supplies to pressure switch 130 a steady stream of vacuum/subatmospheric pressurized air from a point in conduit 47 which joins air valve 46 and conduit line 15. A surge tank 134 may be interposed within vacuum line 132 to prevent any waste liquids that might have flown into conduit 47 from migrating into pressure switch 130. Pressure switch 130 is activated, and therefore allows electric current to flow from power source 112 to the timer module, when the vacuum pressure condition delivered to it falls to or below 12" Hg.

Every time air valve 46 cycles, however, air at atmospheric pressure (defined as 0" Hg) overwhelms the vacuum pressure condition existing in conduit 47 immediately downstream of the valve. Thus, the pressure difference at this point falls temporarily to 0" Hg until plunger assembly 82 seals air valve 46 to terminate the air transport cycle and the source of vacuum pressure in vacuum sewerage transport system 34 can restore the vacuum condition (and therefore the pressure differential) to conduit 47. Because of this sudden loss in pressure differential, pressure switch 130 would be activated every time air valve 46 cycles which, in turn, would cause EAAC module 17 to cycle air valve 46 once again to admit more atmospheric air into conduit line 15 even though the line was not waterlogged, or even close to being waterlogged. As may be readily perceived, such an arrangement of equipment would create perpetual cycling of air valve 46 which not only would place undue wear on the valve and components of EAAC module 17, but also would prevent vacuum pressure from being restored to conduit line 15, so that when waste control valve 40 cycled in response to accumulated sewage in holding tank 12, there would be insufficient pressure differential to transport the sewage to sewage collection station 36. This in turn, would foster waterlogging in conduit line 15, precisely the result which this invention seeks to prevent.

Therefore, a delay-timer module 125 is interposed within the electrical circuit of EAAC module 17 between pressure switch 130 and on-timer module 120. Delay-timer module 125 and on-timer module 120 are combined in time delay relay modules such as Model CKK sold by National Controls Corporation of West Chicago, Ill. Delay-timer module 125 ameliorates the problem of perpetual cycling of air valve 46 by turning to the "off" position when voltage is delivered to it, thereby commencing a delay cycle. At the end of the preselected period of delay, the delay-timer module 125 changes to the "on" position and delivers voltage to on-timer module 120. If at this time pressure switch 130 still determines that the pressure differential in conduit 47 is deficient, then on-timer module 120 will convert to the "on" position (commencing a timer cycle) and deliver current to solenoid valve 100, which thereby causes vacuum/subatmospheric pressure to be delivered to upper housing chamber 77 of air valve 46, and air valve 46 opens to admit atmospheric pressure to conduit line 15.

At the end of the pre-determined timer cycle of on-timer module 120, it will convert to the "off" position, to deactivate solenoid valve 100, and the process will reverse to close air valve 46. Meanwhile, delay-timer module 125 will activate once again to provide a delay period to allow vacuum/subatmospheric pressure to be restored to conduit 47 immediately downstream of air valve 46. Both delay-timer module 125 and on-timer module 120 may have control knobs which permit the time of activation of each unit to be independently adjusted.

While a predetermined differential pressure value of 12" Hg has been chosen for illustrative purposes in this application, it should be understood that pressure switch 130 may be adjusted to monitor other preselected levels of differential pressure. Also, as indicated in FIGS. 4 and 5, power source 112 delivers electrical current at 110 volts. However, this requires the installation of an electrical power wire in the valve pit to make such an amount of voltage available to operate the EAAC unit. Therefore, the components in the EAAC unit may be replaced with corresponding ones which perform similar functions, but operate on 12 volts, so that a simple 12-volt battery can be placed in the valve pit to operate the EAAC unit.

Figure 6:
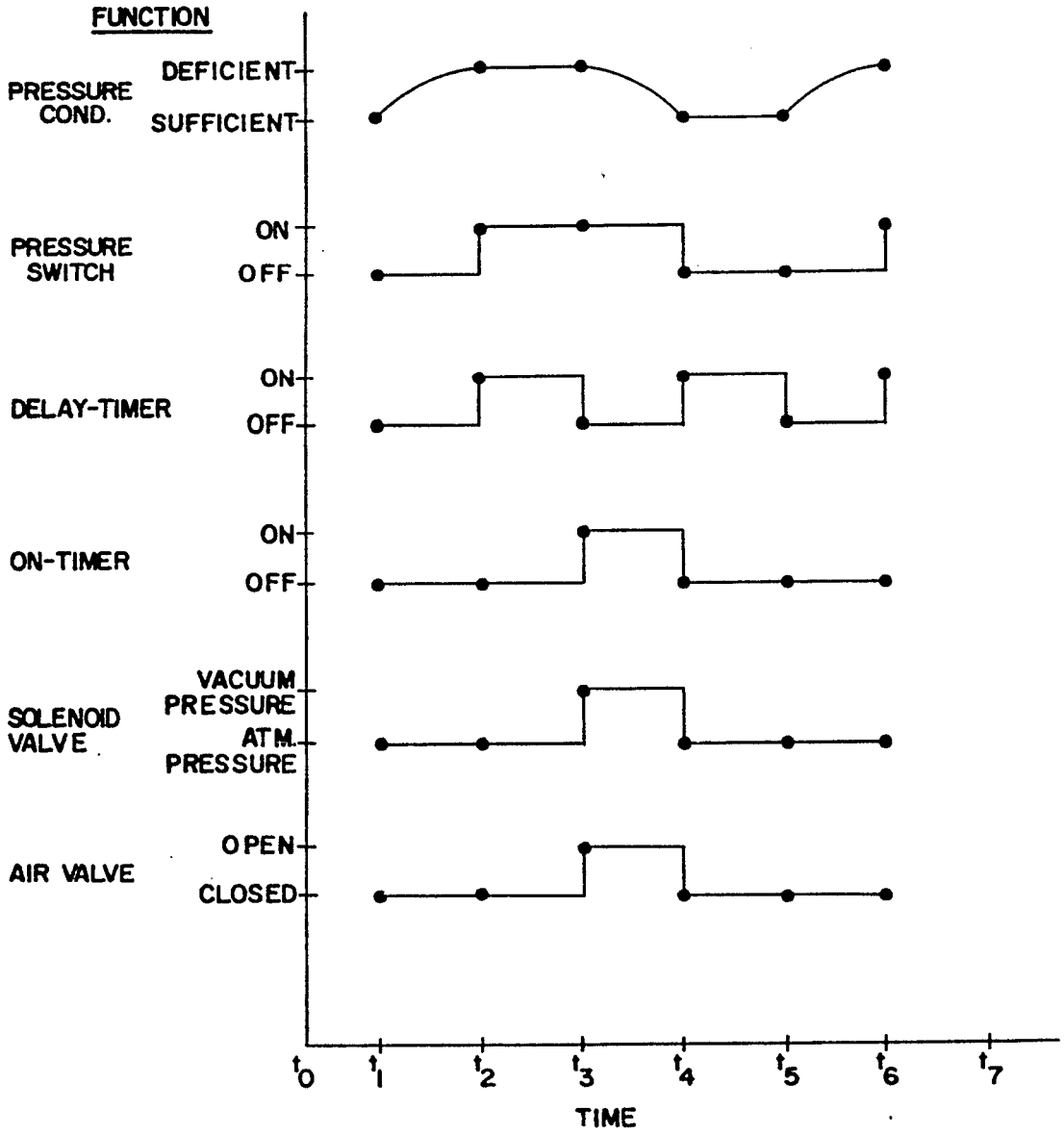
FIG. 6 shows the function of the various components on view in FIG. 5 as a function of time.

FIG. 6 illustrates the interrelation of the various components of EAAC module 17 and air valve 46 in terms of function versus time. At time $t_1$, the pressure differential in conduit line 15 is sufficient, atmospheric pressure is delivered to air valve 46 to keep it closed, and pressure switch 130, delay-timer module 125 and on-timer module 120 are all deactivated ("off"). At time $t_2$, the pressure differential condition becomes deficient, pressure switch 130 is activated and timer-delay 125 module is activated to commence the delay cycle. At time $t_3$, delay-timer module 125 deactivates, the pressure condition is still deficient, and on-timer module 120 activates to activate solenoid valve 100. Meanwhile, vacuum/subatmospheric pressure is delivered to air valve 46 to open it. At time $t_4$, the on-timer module 120 deactivates as does the solenoid valve 100, and atmospheric pressure is once again delivered to air valve 46 to close it. In the meantime, delay-timer module 125 is once again activated. The delay cycle ends at time $t_5$ at which point the pressure condition in conduit line 15 is sufficient to avoid waterlogging. At time $t_6$, the pressure differential is deficient, and the process begins once again.

FIG. 7 shows yet another preferred embodiment of the invention. As revealed in FIG. 3, a unit controller module 45 regulates the cycling of waste control valve 40. Applicants' U.S. Pat. No. 4,373,838 discloses in great detail the structure and operation of the unit-controller module. Basically, the module has air-tight chambers 140, 142, 144, 146, 148, and 150. Vacuum line 54, surge tank 57, and vacuum port 50 ensure that chamber 148 is always maintained at the vacuum/subatmospheric pressure condition in conduit line 15 immediately downstream of control valve 40. Air breather 53, atmospheric pressure conduit 56, atmospheric port 59, and conduit 152 ensure that chambers 150 and 142 are always at atmospheric pressure. Meanwhile, connecting tube 154 brings chambers 144 and 146 to the same vacuum/atmospheric pressure condition which exists in chamber 148. And finally, sensor pipe 13, pressure sensor conduit 48, and pressure sensor port 51 convey the pressure condition in holding tank 12 (which increases as the level of sewage increases) to chamber 140.

In the stand-by position, valve connector port 65 and valve connector 62 deliver atmospheric pressure to the upper housing chamber 77 of waste control valve 40. However, when the pressure build-up in chamber 120 reaches a certain level, pressure communication between the various chambers shuts off delivery of atmospheric pressure from atmospheric port 59 to valve connector 62, and instead vacuum/subatmospheric pressure is delivered from chamber 128 to chamber 130, valve connector 62, and hence upper housing chamber 77 to cause opening of the waste control valve 40. Reversal of this process causes closure of the valve. Thus, like the embodiments of the invention in FIGS. 4 and 5, the unit-controller module 25 opens and closes the valve by delivering vacuum/subatmospheric and atmospheric pressurized air, respectively.

The invention embodied in FIG. 7 connects the EAAC module 17 to the unit-controller module 45, instead of directly to the valve as embodied by the inventions shown in FIGS. 4 and 5. This promotes efficiency and reduces costs because it eliminates the need for special air control valves 46 to admit atmospheric air into conduit line 15. Sewage control valve 40 must already be used to admit sewage into the conduit transport lines, so this valve serves a second function by also allowing entry of atmospheric air when needed to avoid waterlogging in the conduit line 15.

The EAAC module 17 is constructed and operated in the same way as when the EAAC module is connected directly to the valve with one important exception: the atmospheric and vacuum/subatmospheric pressure delivery lines 104 and 106, respectively, connected to solenoid valve 80 are reversed. In this way, compared with each respective position of two-way position solenoid valve 100 in FIGS. 4 and 5, the pressure characteristic of air exiting the solenoid valve and delivered to chamber 144 of the unit-controller module 45 in FIG. 7 will be reversed. Hence, when vacuum/subatmospheric pressure is conveyed via pressure delivery line 102 and connecting tube 154 to chamber 144 of unit-controller module 45, the unit controller is in its stand-by condition which in turn delivers atmospheric pressure to waste control valve 40 to close it. But when atmospheric pressure is conveyed via pressure delivery line 102 and connecting tube 154 to chamber 144, pressure communication between the various chambers of the unit-controller module 45 will cause it to deliver vacuum/subatmospheric pressure to the upper housing chamber 77 of sewage control valve 40 to effect its opening. As is the case with the inventions embodied in FIGS. 4 and 5, the timer cycle of on-timer unit 100 will determine the duration of the air transport cycle of waste control valve 40 while it is being activated by EAAC module 17, and therefore how much air at atmospheric pressure can enter conduit line 15 to prevent or cure any waterlogging. Also like the inventions embodied in FIGS. 4 and 5, delay-timer module 125 and on-timer module 120 may be equipped with control knobs to vary the length of their activation cycles. This will determine not only the length of the air transport cycle of waste control valve 40, but also the duration of delay caused by timer delay module 125 both before and after control valve 40 cycles to ensure that the inadequate pressure differential in conduit line 15 monitored by pressure switch 130 is not unduly transitory.

It should be noted that the embodiment of the invention connecting EAAC unit 17 to unit-controller module 45, instead of directly to the control valve, could use an EAAC module without the pressure switch 130 and delay-timer module 125 (as shown in FIG. 4), merely cycling the control valve every time the on-timer module 120 is activated to, on average, ensure that waterlogging does not occur or eliminate it after it occurs.

Figure 8:
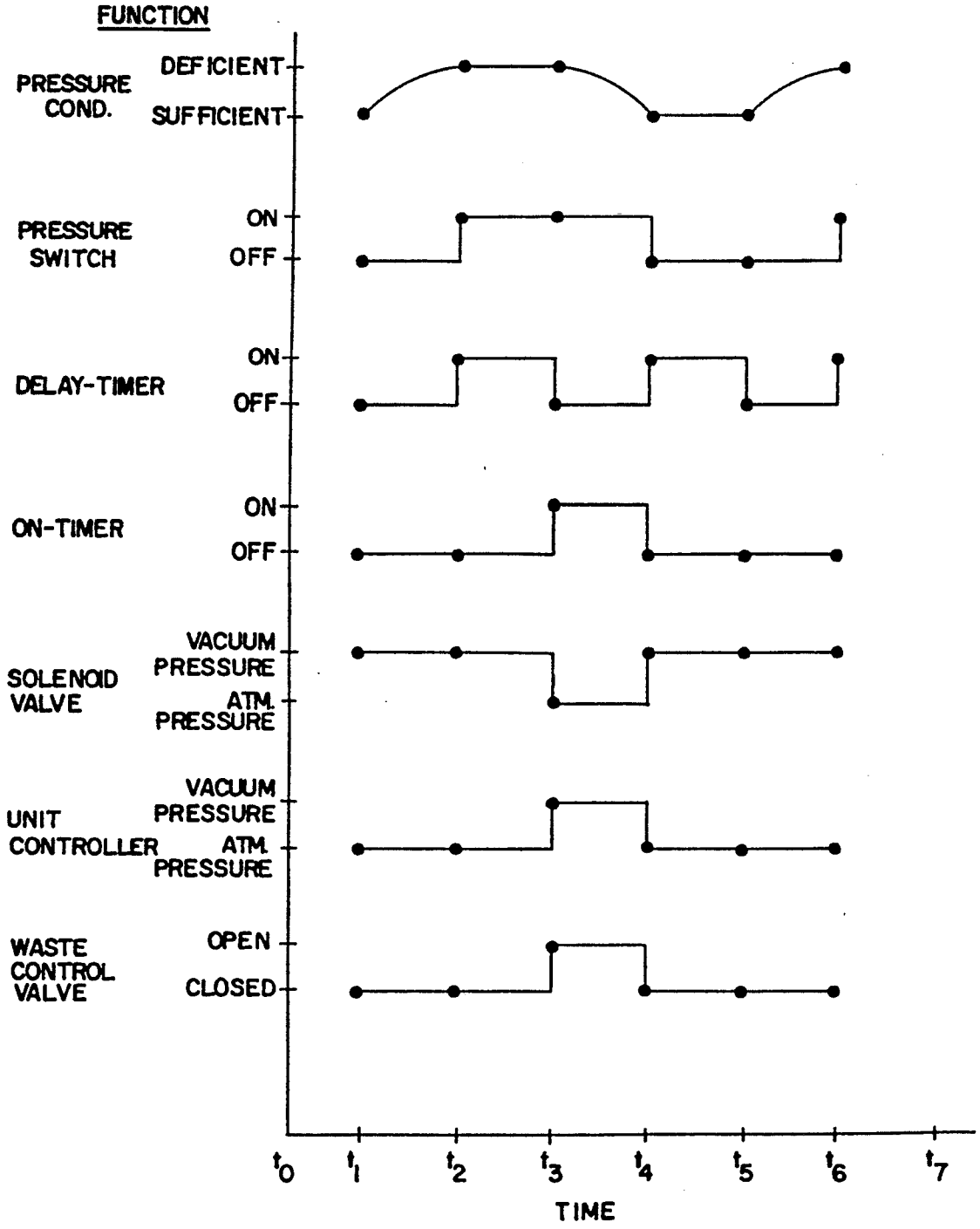
FIG. 8 shows the function of various components on view in FIG. 7 as a function of time.

FIG. 8 shows the invention, as embodied in FIG. 7, in terms of the various component functions versus time. Comparison of FIG. 8 with FIG. 6 will show the primary differences functionally between the inventions of FIG. 7 and FIG. 5.

Figure 9:
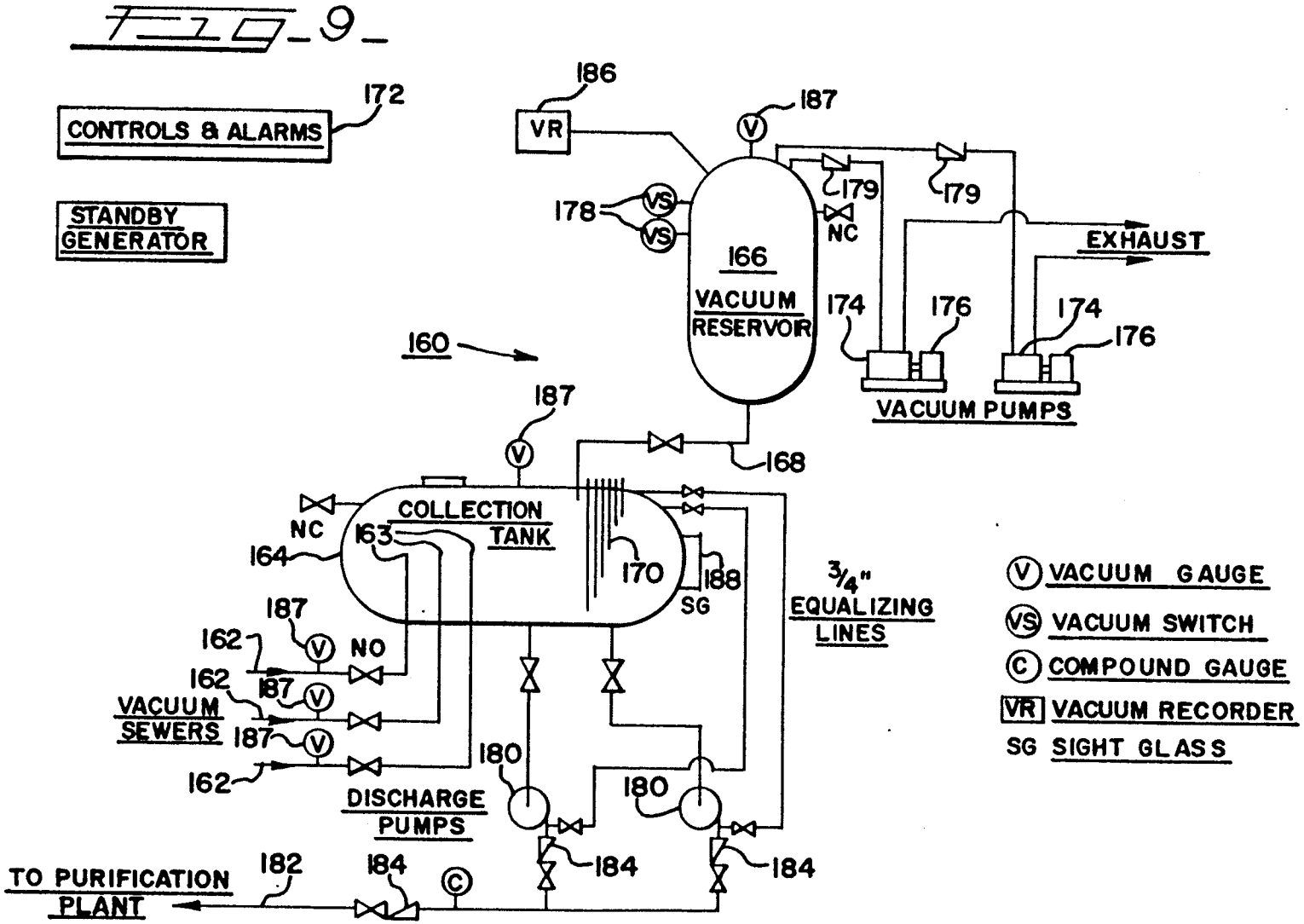
FIG. 9 is a diagrammatical representation of a vacuum collection tank and a vacuum source according to the invention.

Reverting from the electric air admission controller and accompanying vacuum valve, themselves, to the overall vacuum sewerage transport system of the present invention, FIG. 9 illustrates a collection station 160 (shown simply as "black box" 36 in FIG. 3) for receiving the sewage from several vacuum conduits 162. A vacuum collection tank 164 for receiving the sewage from the vacuum conduits 162 may be fabricated, for example, from welded steel or fiberglass. A vacuum reservoir 166 serves as a source of vacuum or subatmospheric pressure for the collection tank 164 and the main vacuum conduits 162, the vacuum reservoir 166 communicating with the collection tank by means of a vacuum connecting pipe 168. Level control probes 170 are provided in the sewage vacuum collection tank 164 for providing sewage depth information in the collection tank 164 to the controls and alarms circuitry 172 by appropriate connection means (not shown). Controls and alarms circuit 172 has output signals (not shown) which provide appropriate control signals for the various system components, as required. Vacuum pumps 174 driven by appropriately controlled motors 176 maintain between 16 and 20 inches of mercury vacuum in the vacuum reservoir 166 with the aid of the vacuum switches 178 and check valves 179. The vacuum pumps 174 may be, for example, of either the liquid-ring or the sliding-vane type known in the art. The discharge pumps 180 in conjunction with the level control probes 170 and the controls and alarms circuitry 172 are activated to empty the vacuum collection tank 164 contents into a pressurized sewerage line 182 which feeds the sewage to an appropriate purification plant. The sewage level in collection tank 164 is always maintained at a level below the ends 163 of the vacuum conduits 162. This provides unobstructed communication of vacuum or subatmospheric pressure from the reservoir 166 to the conduits 162 at all times. The discharge pumps 180 may be, for example, vertical, open impeller, non-clog types which have mechanical shaft seals and oil pressurizers. Check valves 184 are installed in the discharge pump outlets and the pressurized sewage line 182. Appropriate shut-off valves are provided as shown in the collection station 160 diagrammatic representation. Alarm circuitry and indicators are included as part of circuitry 172. A vacuum recorder 186 and vacuum gauges 187 are provided to monitor vacuum pressure. A sight glass 188 is also provided for determining the sewage level within the vacuum collection tank.

While particular embodiments of the invention have been shown and described, it should be understood that the invention is not limited thereto, since many modifications may be made. For instance, rather than use electricity as the means of operative communication between various components of the system, the air admission controller could employ fluidics and function with equally desirable results. Moreover, while this application has oriented itself towards a discussion of the preferred embodiment of the invention, viz., the transport under differential pressure of sewage, the word "sewage" is meant to be interpreted in its broadest sense to include any waste liquid. For example, the vacuum transport system and EAAC module could be combined to transport used cutting oil collected in a reservoir. The invention is therefore contemplated to cover by the present application any and all such modifications which fall within the true spirit and scope of the basic underlying principles disclosed and claimed herein.

What is claimed is:

1. An improved vacuum system for transporting waste liquids from a source at a given air pressure, including an air admission controller for automatically regulating the opening and closing of a control valve connected to a vacuum transport conduit to admit atmospheric pressure into the conduit, comprising:

a. vacuum collection means for receiving waste liquids and having a pressure less than the pressure of the source;

b. a control valve for injecting the waste liquids, having an inlet coupled to the source of waste liquids and having an outlet for injecting the waste liquids and air;

c. conduit means coupled to the vacuum collection means and coupled to the outlet of the control valve, said conduit means having at least one riser, low point, and downslope, and being laid out in a saw-toothed fashion between the collection means and the injection means outlet so that when no flow occurs, waste liquids may collect in the low point, and there is minimal intermittent closure of said conduit means over time to permit minimal drop in vacuum or subatmospheric pressure throughout said conduit means such that there is more than adequate vacuum or subatmospheric pressure available to operate said control valve; and d. an air admission controller, comprising:

i. a timer unit having a first activated condition and a second inactivated condition;

ii. a source of vacuum or subatmospheric pressure;

iii. a source of atmospheric pressure;

iv. means, operatively in communication with said timer unit, for establishing communication of one of these pressure condition with the control valve, which, in response thereto, either opens or closes the valve to commence or terminate an air transport cycle within the transport conduit, wherein vacuum or subatmospheric pressure is delivered while said timer is in one condition, and wherein atmospheric pressure is delivered while said timer is in another condition; and v. a housing for containing the components of the air admission controller.

2. A vacuum system as recited in claim 1, wherein said means for establishing pressure communications is a solenoid valve.

3. A vacuum system as recited in claim 1, wherein vacuum or subatmospheric pressure is delivered to the control valve when the pressure differential within the transport conduit downstream of the control valve is at or below a preselected level.

4. A vacuum system as recited in claim 3, wherein the preselected pressure differential level is 12" Hg.

5. A vacuum system as recited in claim 1, wherein said timer has control means for adjusting the duration of the air transport cycle.

6. A vacuum system as recited in claim 1, wherein the source of waste liquids includes a gravity-fed holding tank.

7. A vacuum system as recited in claim 6, wherein the waste liquids in the holding tank are exposed to atmospheric pressure, and wherein the vacuum collection means is maintained at vacuum or subatmospheric pressure.

8. A vacuum system as recited in claim 1, wherein the waste liquid is sewage.

9. An improved vacuum system for transporting waste liquids from a source at a given air pressure, including an air admission controller for automatically regulating the opening and closing of a control valve connected to a vacuum transport conduit to admit atmospheric pressure into the conduit, comprising:

a. vacuum collection means for receiving waste liquids and having a pressure less than the pressure of the source;

b. a control valve for injecting the waste liquids, having an inlet coupled to the source of waste liquids and having an outlet for injecting the waste liquids and air;

c. conduit means coupled to the vacuum collection means and coupled to the outlet of the control valve, said conduit means having at least one riser, low point, and downslope, and being laid out in a saw-toothed fashion between the collection means and the injection means outlet so that when no flow occurs, waste liquids may collect in the low point, and there is minimal intermittent closure of said conduit means over time to permit minimal drop in vacuum or subatmospheric pressure throughout said conduit means such that there is more than adequate vacuum or subatmospheric pressure available to operate said control valve; and d. an air admission controller, comprising:

i. a timer unit having a first activated condition and a second inactivated condition;

ii. a timer-delay module, operatively in communication with said timer unit, which activates and deactivates to commence and terminate a delay cycle, said timer unit activating to commence the air transport cycle of the control valve only if the pressure differential in the vacuum transport conduit is at or below a preselected level after said delay cycle terminates, and another delay cycle being caused by said timer-delay module after the termination of the air transport cycle;

iii. means for determining the pressure differential existing in the vacuum sewerage transport conduit downstream of the control valve, wherein said pressure determining means activates said timer-delay module when the pressure differential is at or below the preselected level;

iv. a source of vacuum or subatmospheric pressure;

v. a source of atmospheric pressure;

vi. means operatively in communication with said timer unit for establishing communication of one of these pressure conditions with the control valve, which, in response thereto, either opens or closes the valve to commence or terminate an air transport cycle within the transport conduit, wherein vacuum or subatmospheric pressure is delivered while said timer unit is in another condition; and vii. a housing for containing the components of the air admission controller.

10. A vacuum system as recited in claim 9, wherein said pressure-determining means is a pressure switch.

11. A vacuum system as recited in claim 9, wherein said means for establishing pressure communication is a solenoid valve.

12. A vacuum system as recited in claim 9, wherein said timer-delay module has control means for adjusting the duration of the delay cycle.

13. A vacuum system as recited in claim 9, wherein said timer has control means for adjusting the duration of the air transport cycle.

14. A vacuum system as recited in claim 9, wherein the preselected pressure differential level is 12" Hg.

15. A vacuum system as recited in claim 9, wherein said pressure delivery means is connected to a pressure differential operating apparatus, which, in turn, is connected to the control valve, whereby atmospheric pressure is delivered to the operating apparatus which conveys vacuum or subatmospheric pressure to the control valve to commence an air-transport cycle while said timer unit is activated, and a vacuum or subatmospheric pressure is delivered to the operating apparatus which conveys atmospheric pressure to the control valve to terminate the air transport cycle while said timer unit is deactivated.

16. A vacuum system as recited in claim 9, wherein the source of waste liquids includes a gravity-fed holding tank.

17. A vacuum system as recited in claim 16, wherein the waste liquids in the holding tank are exposed to atmospheric pressure, and wherein the vacuum collection means is maintained at vacuum or subatmospheric pressure.

18. A vacuum system as recited in claim 9, wherein the waste liquid is sewage.

19. An improved vacuum sewerage system for transporting an intermittently injected sewage mass, including an air admission controller for automatically regulating the opening and closing of a control valve connected to a vacuum transport conduit to admit atmospheric pressure into the conduit, comprising:

a. at least one gravity-fed sewage pipe;

b. a collection tank fed by the gravity-fed sewage pipe for holding sewage, said sewage being exposed to atmospheric pressure;

c. an intermittently operated sewage injection valve having an inlet and an outlet, said inlet coupled to the collection tank;

d. a source of vacuum pressure;

e. a vacuum collection tank having an inlet and having vacuum pressure applied thereto from the source of vacuum pressure;

f. a conduit section coupled between the sewage injection valve outlet and the collection tank for transporting sewage in the form of a hollow cylinder, said conduit means being laid out in a saw-toothed fashion, having at least one riser, low point, and downslope so that when no injected sewage mass is being transported therein the low point collects sewage with minimal intermittent closure of said conduit means over time to permit minimal drop in vacuum or subatmospheric pressure throughout said conduit means such at there is more than adequate vacuum or subatmospheric pressure available to operate said control valve; and g. an air admission controller, comprising:

i. a timer unit having a first activated condition and a second inactivated condition, and control means for adjusting the duration of an air transport cycle;

ii. a timer-delay module, operatively in communication with said timer unit, which activates and deactivates to commence and terminate a delay cycle, said timer unit activating to commence the air transport cycle of the injection valve only if the pressure differential in the vacuum transport conduit is at or below a preselected level after said delay cycle terminates, another delay cycle being caused by said timer-delay module after the termination of the air transport cycle, and said timer-delay module having control means for adjusting the duration of the delay cycle;

iii. a pressure switch for determining the pressure differential existing in the vacuum sewerage transport conduit downstream of the control valve, wherein said pressure switch activates said timer-delay module when the pressure differential is at or below a pre-determined level;

iv. a source of vacuum or subatmospheric pressure;

v. a source of atmospheric pressure;

vi. a solenoid valve operatively in communication with said timer unit for establishing communication of one of these pressure conditions with the injection valve, which, in response thereto, either opens or closes the valve to commence or terminate an air transport cycle within the transport conduit, wherein vacuum or subatmospheric pressure is delivered while said timer unit is in another condition; and vii. a housing for containing the components of the air admission controller.

20. A vacuum sewerage system as recited in claim 19, wherein the preselected pressure differential level is 12" Hg.

21. A vacuum sewerage system as recited in claims 1, 9, or 19, wherein the operative means of communication between at least two of the components of the air admission controller is fluidics.

22. A vacuum sewerage system as recited in claims 1, 9, or 19, wherein the operative means of communication between at least two of the components is electricity.

23. A vacuum sewerage system as recited in claim 19, wherein said solenoid valve is connected to a pressure differential operating apparatus, which, in turn, is connected to the injection valve, whereby atmospheric pressure is delivered to the operating apparatus which conveys vacuum or subatmospheric pressure to the injection valve to commence an air-transport cycle wile said timer unit is activated, and vacuum or subatmospheric pressure is delivered to the operating apparatus which conveys atmospheric pressure to the injection valve to terminate the air-transport cycle while said timer unit is deactivated.

24. A vacuum sewerage system as recited in claim 1, 9, or 19, wherein multiple saw-toothed profiles may be employed in the conduit such that the sum of the pressure losses across all the risers equals or exceeds the sum of the minimum vacuum or subatmospheric pressure condition available at the vacuum collection tank minus the pressure head required to operate the control valve, the total lift across all the risers of the conduit equaling or exceeding 13 feet.

25. An improved method of transporting air and waste liquid through a vacuum system, and automatically regulating the opening and closing of a control valve to inject air at atmospheric pressure into a vacuum transport conduit containing the waste liquid, independently of the level of accumulated waste liquid, to avoid a waterlogged condition, comprising:

a. laying a vacuum conduit in a saw-toothed fashion having a bore and having at least one riser, low point, and downslope so that when no flow is occurring the low point contains waste liquid and the downslope and riser are air filled with minimal intermittent closure of said conduit over time to permit minimal drop in vacuum or subatmospheric pressure throughout said conduit such that there is more than adequate vacuum or subatmospheric pressure available to operate the control valve;

b. providing a valve at one end of the conduit and opening the valve to admit waste liquid from a source of waste liquid into the conduit, the waste liquid forming a hollow cylindrical mass which sweeps through the conduit from the valve end thereof towards the collection means;

c. holding the valve open a pre-determined amount of time after the waste liquid has been admitted to permit a quantity of air to enter;

d. monitoring the pressure differential level within the vacuum transport conduit downstream of the valve;

e. activating a delay-timer module by means of a pressure switch when the vacuum pressure falls below a preselected level;

f. activating a timer module if the vacuum pressure is at or below the pre-determined level once said delay-timer module deactivates;

g. activating a solenoid valve, whereby vacuum or subatmospheric pressure is delivered to the valve;

h. deactivating said solenoid valve once said timer module deactivates, whereby atmospheric pressure is delivered to the control valve; and i. activating the delay-timer module to cause another delay cycle.

26. A method of transporting air and waste liquid as recited in claim 25, wherein atmospheric pressure is applied on the waste liquid in the waste liquid source, and wherein a partial vacuum is provided at the collection means.

27. A method for transporting air and waste liquid as recited in claim 25, further comprising the step of adjusting the duration of the activation cycle of said delay-timer module.

28. A method for transporting air and waste liquid as recited in claim 25, further comprising the step of adjusting the duration of the activation cycle of said timer module.

29. A method for transporting air and waste liquid as recited in claim 25, wherein said pressure switch activates said delay-timer module when the vacuum pressure is at or below 12" Hg.

30. A method for transporting air and waste liquid as recited in claim 25, wherein the waste liquid is sewage.

* * * * *